US005290652A

United States Patent [19]

Harakawa et al.

[11] Patent Number: 5,290,652

[45] Date of Patent: Mar. 1, 1994

[54] DEVELOPING COMPOSITIONS FOR ELECTROPHOTOGRAPHY

[75] Inventors: Koji Harakawa; Takayuki Sano; Makoto Miura; Akira Fujiwara, all of Shizuoka, Japan

[73] Assignee: Tomoegawa Paper Co., Ltd., Tokyo, Japan

[21] Appl. No.: 967,068

[22] Filed: Oct. 28, 1992

[30] Foreign Application Priority Data

Nov. 13, 1991 [JP] Japan ..... 3-323982

[51] Int. Cl.[5] ..... G03G 9/107; G03G 9/10

[52] U.S. Cl. ..... 430/106.6; 430/108; 430/110

[58] Field of Search ..... 430/106.6, 108, 111; 252/62.56

[56] References Cited

U.S. PATENT DOCUMENTS 4,282,302 4/1981 Makino et al. ..... 430/106.6

4,598,034 7/1986 Honjo et al. ..... 430/106.6

4,977,054 12/1990 Honjo et al. ..... 430/106.6

*Primary Examiner*—Christopher Rodee

*Attorney, Agent, or Firm*—Finnegan, Henderson, Farabow, Garrett & Dunner

[57] ABSTRACT

An object of the present invention to provide novel developing compositions for use in electrphotography which do not cause an adherence of ferrite carriers to the surface of a photoconductor while maintaining high definition and high picture quality of the picture image by using fine size ferrite carriers. The aforementioned developing compositions for use in elecrophotography comprise toners which contain a binding resin and colorant as main components, and ferrite carriers comprised of 5 to 40 mol % of ZnO and 60 to 95 mol % of $Fe_2O_3$, and possess a saturated magnetization value of 70 to 100 emu/g in an applied magnetic field of 3000 oersted.

2 Claims, No Drawings

DEVELOPING COMPOSITIONS FOR ELECTROPHOTOGRAPHY

BACKGROUND OF THE INVENTION

1. Field of the Invention

The present invention relates to developing compositions used in developing an electrostatic latent image by an electrophotography process, electrographic recording method, or electrographic printing method or the like.

As electrophotography developing methods, there exist a cascade developing method, a magnetic brush developing method, and the like. Characteristics required for the toner and the carrier used in these methods include, characteristics such as possession of a toner of appropriate degree of triboelectric charging, uniform particle size, stabilization of the surface condition using temperature and the like by various unchanging characteristics, and the like.

A various materials have been used in prior art as the carriers and the toner which satisfy the above characteristics. However, recently ferrite carriers having a stable charge characteristic are being widely employed.

Ferrite carriers used in the past, in general, possessed the following characteristics: a particle size distribution was 40 to 180 μm; a large average particle diameter of approximately 100 μm; basic composition containing BaO, ZnO, CuO, MgO, MnO, and the like, with $Fe_2O_3$ as the main component; an electrical resistance rate of $10^3$ to $10^{12}$ ohm cm; a saturated magnetization value of 10 to 80 emu/g in an applied magnetic field of 3000 oersted; and particle surfaces coated with an oxide or a resin film.

However, recent copy picture images increasingly require high definition and high picture image quality. In order to satisfy these needs, there is growing demand for ferrite carriers having small particle size with the range of distribution of the particle diameter ranging from 30 to 150 μm and with an average particle diameter of 50 to 60 μm.

However, because almost all of the ferrite carriers having small particle size, such as these having an average particle diameter of less than 60 μm, were barely magnetized, the ferrite carriers separated easily from the developing sleeve, and adhered to the surface of the photoconductor, or jumped out of the developing machine. Therefore problems occurred such as damage to the photoconductor and the photoconductor cleaning blade, dirtiness falling on the picture image and into the copy machine, and the like.

Consequently, in order to solve these problems, particles having a particle diameter of less than 60 μm had to be removed. Because of this it is very difficult to obtain by a conventional techniques a high quality picture image using ferrite carriers consisting of small size particles.

Therefore, in order to obtain a high quality picture image having high definition by using prior art ferrite carriers with an average particle diameter of approximately 100 μm, the volume average particle diameter of the toner must be decreased to 10 μm or less. However, lowering the particle diameter of the toner gives rise to problems such as increased dependency on the environment, instability due to rising of electrical values of the toner, a decrease in the fluidity of the toner, degradation of anti-heat longevity, a decrease in the density of the picture images, an increase in background contamination, and the existence of poor cleaning properties.

SUMMARY OF THE INVENTION

It is therefore an object of the present invention to provide novel developing compositions for use in elecrophotography which do not cause an adherence of ferrite carriers to the surface of a photoconductor while maintaining high definition and high picture quality of the picture image by using fine size ferrite carriers.

Said new developing compositions for use in elecrophotography comprise toners which contain a binding resin and a colorant as main components; and ferrite carriers comprised of 5 to 40 mol % of ZnO and 60 to 95 mol % of $Fe_2O_3$, with a saturated magnetization value of 70 to 100 emu/g in an applied magnetic field of 3000 oersted.

In the following a detailed descriptions of the developing compositions of the present invention will be given.

The basic composition of the ferrite carriers according to the present invention is characterized by use of a bivalent metallic oxide such as $Fe_2O_3$ and ZnO. However, in the case of using another metallic oxide instead of ZnO, it is impossible to realize the aforementioned saturated magnetization value. ZnO does not maintain a magnetic force itself, however in the case when ZnO is mixed with other metallic oxides, it exhibits effectively the magnetic properties of metallic oxides. However, in the case when ZnO is used with $Fe_2O_3$ and another metallic oxide such as CuO, MgO, MnO, or BaO, the magnetic properties of each metallic oxides are offset, and it becomes impossible to satisfy the aforementioned saturated magnetization value.

When the average particle diameter ranges from 50 to 60 μm and when the saturated magnetization value is 70 emu/g or less, traditional problems such as the adherence of ferrite carriers to the surface of the photoconductor and the like occur, and a value satisfying the picture image density at a low developing voltage can not be obtained. Moreover, when the saturated magnetization value of the ferrite carrier is 100 emu/g or greater, repetition of narrow lines as well as a homogeneity of the black parts of the picture image cannot be obtained.

In the present invention, when the range of a saturated magnetization value is 70 to 100 emu/g, it is possible to prevent the occurrence of problems such as the adherence of the ferrite carrier to the surface of the photoconductor and the like, if the percent weight of the ferrite carrier, having a particle size of 63 μm or less, is less than 30% of the particle size distribution, preferably less than 10%.

In particular, developing compositions for use in elecrophotography according to the present invention can also be used in low developing voltage systems such as in a reversal developing process, supplying favorable results. For example, since the forms of developing compositions, formed inside a developing bath on a magnetic sleeve controlled at a fixed gap by means of the magnetic force maintained by the ferrite carriers differ, obviously the height of the crests formed by ferrite carriers having a strong magnetic force will increase. As a result, the contact area with the photoconductor surface will increase, the supplying of toner to the latent image on the surface of the photoconductor becomes easier, and a high density picture image can be obtained even at a low developing voltage.

Moreover, surfaces of ferrite carriers according to the present invention can be respectively coated or not coated with a resin. As the aforementioned resin there can be mentioned fluorine-containing resins, acrylate resins, styrene-alkyl copolymer resins, silicon resins, polyester resins, polybutadiene resins, and the like.

When the electrical resistance rate of the ferrite carriers according to the present invention is $10^2$ ohm.cm or less, a picture image having high definition and high picture quality cannot be obtained because the electrical resistance is too low. However when the electrical resistance is $10^{12}$ ohm.cm or greater, applications of bias voltage becomes difficult, the background and surface of the photoconductor become increasingly dirty, and density decrease of the picture image occurs easily, all of which are undesirable.

The ferrite carriers according to the present invention are made by the steps comprising mixing $Fe_2O_3$ and ZnO at a fixed ratio, burning them at 800° to 1000° C. for several hours, and then grinding into fine particles. Following this, a binding agent such as polyvinylalchol is added to the fine particles as necessary, and globular particles are then obtained after spray-drying under a heated atmosphere. The ferrite carriers can then be obtained by classifying them after baking the globular particles obtained at a temperature of 1100° to 1300° C. under a heated nitrogen gas atmosphere.

A satisfactory saturated magnetization value can be obtained by baking the ferrite carriers under the heated nitrogen gas atmosphere, because the ferrite carriers are oxidized and partially reduced at the same time, and because a magnetized FeO possessing strong magnetic force is generated. Under another type of atmosphere, for example hydrogen gas atmosphere, the ferrite carriers having the same quality as that made at nitrogen gas atmosphere can be obtained, although there are no superior points, because the manufactory process involves dangers such as an explosion or the like, in addition to increased costs. Moreover, when the steps are carried out in air, this is different from the nitrogen gas atmosphere, since the ferrite carriers can not be reduced. As a result, a satisfactory saturated magnetization value cannot be obtained.

The toner which is comprised of developing compositions for elecrophotography of the present invention can be obtained by mixing and heat melting a binding resin, a charge control agent, a colorant, and other additives followed by cooling and caking, after which pulverization or classification is carried out. Moreover, a polymerized toner can be used in the developing compositions for use in elecrophotography of the present invention, which can be obtained by placing a monomer compositions with a colorant or the like, and polymerizing them using a suspension polymerization method.

As a suitable binder resin for the toner according to the present invention there can be mentioned, for example, a styrene resin, a polyacrylic ester resin, a styrene-acrylic ester copolymer resin, polyvinyl chloride, polyvinyl acetate, polyvinylidene chloride, a phenol aldehyde resin, a epoxy resin, a polyester resin, and the like.

As the charge control agents there can be mentioned, for example, quaternary ammonium salt, titanates or carbonates of calcium, barium and the like, alkoxylated amines, polyamide resins such as a nylon and the like, polyamine resin such as condensation polymer having an amino group, or the like.

As the colorants according to the present invention there can be mentioned, for example, carbon black, monoazo red colorant (permanent red 4R or the like), disazo yellow colorant, quinacridone magenta colorant, anthraquinone dye, or the like.

As other additives which can be added to the toner, there can be mentioned, for example, lubricants, anti-friction agents, fixing assistant agents and the like, such as polytetrafluoroethylene powder, metallic salts of higher fatty acids, cerium oxide, polyethylenes of low molecular weight, polypropylenes of low molecular weight and the like.

DETAILED DESCRIPTION OF PREFERRED EMBODIMENTS

The present invention will be explained in detail herein below with reference to the examples. In the examples, all "parts" designate "parts by weight".

Production of Toner A

The composition of the toner used in the examples of the present invention or the comparative examples are as follows.

| | |
|---|---|
| Styrene-acrylic acid ester copolymer resin (monomer composition: styrene/methylmetaacrylate/butylacrylate) | 100 parts |
| Polypropylene of low molecular weight ("VISCOL 550P", produced by Sanyo Chemical Industries Co., Ltd.) | 3 parts |
| Metallic colorant containing chromium ("Spilon black TRH" produced by Hodogaya Chemical Industries Co., Ltd.) | 1 part |
| Carbon black ("MA-100", produced by Mitsubishi Chemical Industries Co., Ltd.) | 5 parts |

After the mixture of the above-described compositions was heat-melted by extruder, the small size particles having an volume average particle diameter of 8.5 μm and 12% out of every 100% had a particle diameter of 5 μm or less in number-size distribution, were obtained by kneading by jet mill, and them classifying. Following this, the toners were then obtained by mixing as the fluidization agent, 0.3 parts of $SiO_2$ ("R-972" produced by Aerosil Co., Ltd.) per 100 parts of said small size particles using a Henschel Mixer. The method of measuring the diameter of the toner particles was carried out by coaltar counter (produced by Coaltar Electric Co., Ltd. U.S.A.) with an avature tube having a diameter of 100 μm.

EXAMPLE 1

The developing composition for elecrophotography of the present invention was produced by mixing 4 parts of said toner A with 96 parts of the ferrite carriers coated with a silicon resin possessing a saturated magnetization value of 80 emu/g in applied magnetic field of 3000 oersted, an electrical resistance rate of $10^5$ ohm.cm, and the particle size distribution shown in table 1.

Furthermore, the measuring of the particle size distribution of the ferrite carriers used in the present invention was carried out in accordance with the measuring method of iron powder JIS-H2601 measuring method using the standard node of JIS-Z8801.

The image quality test of said developing compositions was carried out by changing the bias voltage to 200 V to 600 V using a laser printer ("L-980" produced by Kyosera Co., Ltd.). The test was carried out at 10° C./15% RH and 35° C./85% RH respectively. The picture image density (ID) was measured by Machbeth illuminometer. The dirtiness of the background (BG) was measured by Hanter brightness measure assembly, and the carrier adherence (Ca adherence) was measured by counting the number of carriers adhering to the surface of the photoconductor through observation. The evaluation of the picture image quality shows the average value of five straight picture image line amplitudes photographed by a laser printer ("L-980", produced by Kyosera Co., Ltd.) using the picture image treatment assembly ("EXCEL II", produced by Japan Abionics Co., Ltd.). The results of the evaluation are shown in tables 2 through 6.

EXAMPLE 2

The developing compositions for use in elecrophotography of the present invention were produced by mixing 4 parts of said toner A with 96 parts of the ferrite carriers coated with a silicon resin comprised of 35 mol % of ZnO and 65 mol % of $Fe_2O_3$, possessing a saturated magnetization value of 93 emu/g in an applied magnetic field of 3000 oersted, an electrical resistance rate of $10^5$ ohm.cm, and the particle size distribution shown in table 1.

Said developing compositions were evaluated in the same manner as that of the Example 1, and the results are shown in tables 2 through 6.

EXAMPLE 3

The developing compositions for use in elecrophotography of the present invention were produced by mixing 4 parts of said toner A with ferrite carriers of 96 parts coated with a silicon resin comprised of 20 mol % of ZnO and 80 mol % of $Fe_2O_3$, possessing a saturated magnetization value of 98 emu/g in an applied magnetic field of 3000 oersted, an electrical resistance rate of $10^5$ ohm.cm, and the particle distribution shown in table 1.

Said developing compositions were evaluated in the same manner as that of the Example 1, and the results are shown in tables 2 through 6.

COMPARATIVE EXAMPLE 1

The developing compositions for use in elecrophotography of the present invention were produced by mixing 4 parts of the same toner A as in Example 1 with 96 parts of ferrite carriers coated with a silicon resin comprised of 20 mol % of CuO, 30 mol % of ZnO and 50 mol % of $Fe_2O_3$, possessing a saturated magnetization value of 58 emu/g in an applied magnetic field of 3000 oersted, and the particle distribution shown in table 1.

Said developing compositions were evaluated in the same manner as that of Example 1, and the results are shown in tables 2 through 6.

COMPARATIVE EXAMPLE 2

The developing compositions for use in elecrophotography of the present invention were produced by mixing 4 parts of the same toner A as Example 1 with 96 parts of ferrite carriers coated with a silicon resin comprised of 12 mol % of CuO, 18 mol % of ZnO and 70 mol % of $Fe_2O_3$, possessing a saturated magnetization value of 38 emu/g in an applied magnetic field of 3000 oersted, the particle distribution shown in table 1.

Said developing compositions were evaluated in the same manner as that of Example 1, and the results are shown in tables 2 through 6.

TABLE 1

Particle distribution of the ferrite carriers (unit: % weight)

| Node mesh | Example 1 | Example 2 | Example 3 | Comparative Example 1 | Comparative Example 2 |
|---|---|---|---|---|---|
| (+) 177 μm | | | | | |
| 177~149 | | | | 0.1 | 0.3 |
| 149~105 | | | | 38.9 | 32.0 |
| 105~74 | 1.3 | 3.3 | 4.8 | 58.4 | 60.9 |
| 74~63 | 71.3 | 72.0 | 74.4 | 2.6 | 6.4 |
| 63~44 | 20.6 | 19.5 | 17.3 | | 0.4 |
| 44~37 | 6.7 | 5.1 | 3.5 | | |
| (−) 37 | 0.1 | 0.1 | | | |

TABLE 2

Data (under 10° C., 15% RH)

| Article | Bias voltage 600 V ID | BG | Ca adherence | 500 V ID | BG | Ca adherence | 400 V ID | BG | Ca adherence |
|---|---|---|---|---|---|---|---|---|---|
| Example 1 | 1.43 | 0.76 | 5 | 1.4 | 0.61 | 3 | 1.35 | 0.56 | 0 |
| Example 2 | 1.43 | 0.65 | 8 | 1.4 | 0.61 | 3 | 1.37 | 0.49 | 0 |
| Example 3 | 1.45 | 0.67 | 6 | 1.42 | 0.63 | 5 | 1.37 | 0.52 | 0 |
| Comparative Example 1 | 1.37 | 1.86 | 100 | 1.35 | 1.76 | 50 | 1.3 | 1.14 | 20 |
| Comparative Example 2 | 1.35 | 1.54 | * | 1.34 | 1.5 | * | 1.25 | 0.89 | 50 |

*Measurement not possible.

TABLE 3

Data (under 10° C., 15% RH)

| Article | Bias voltage 300 V ID | BG | Ca adherence | 200 V ID | BG | Ca adherence |
|---|---|---|---|---|---|---|
| Example 1 | 1.3 | 1.05 | 0 | 1.26 | 0.51 | 0 |
| Example 2 | 1.32 | 0.43 | 0 | 1.24 | 0.42 | 0 |
| Example 3 | 1.32 | 0.44 | 0 | 1.25 | 0.44 | 0 |
| Comparative Example 1 | 1.21 | 0.76 | 3 | 0.99 | 0.61 | 0 |
| Comparative Example 2 | 1.17 | 0.64 | 10 | 0.81 | 0.55 | 10 |

TABLE 4

| | Data (under 35° C., 85% RH) | | | | | | | | |
|---|---|---|---|---|---|---|---|---|---|
| | Bias voltage | | | | | | | | |
| | 600 V | | | 500 V | | | 400 V | | |
| Article | ID | BG | Ca adherence | ID | BG | Ca adherence | ID | BG | Ca adherence |
| Example 1 | 1.45 | 0.32 | 0 | 1.42 | 0.72 | 0 | 1.38 | 0.62 | 0 |
| Example 2 | 1.45 | 0.77 | 0 | 1.42 | 0.73 | 0 | 1.37 | 0.59 | 0 |
| Example 3 | 1.45 | 0.76 | 0 | 1.44 | 0.68 | 0 | 1.37 | 0.55 | 0 |
| Comparative Example 1 | 1.41 | 2.21 | 50 | 1.37 | 1.86 | 30 | 1.33 | 1.26 | 10 |
| Comparative Example 2 | 1.42 | 1.96 | * | 1.38 | 1.74 | 100 | 1.31 | 1.31 | 30 |

*Measurement not possible.

TABLE 5

| | Data (under 35° C., 85% RH) | | | | | |
|---|---|---|---|---|---|---|
| | Bias voltage | | | | | |
| | 300 V | | | 200 V | | |
| Article | ID | BG | Ca adherence | ID | BG | Ca adherence |
| Example 1 | 1.35 | 1.55 | 0 | 1.31 | 0.55 | 0 |
| Example 2 | 1.34 | 0.59 | 0 | 1.29 | 0.52 | 0 |
| Example 3 | 1.35 | 0.56 | 0 | 1.29 | 0.49 | 0 |
| Comparative Example 1 | 1.3 | 0.98 | 0 | 0.21 | 0.38 | 0 |
| Comparative Example 2 | 1.26 | 0.36 | 5 | 1.16 | 0.31 | 5 |

TABLE 6

| | Evaluation of picture quality (unit: μm) | |
|---|---|---|
| | 10° C., 15% RH | 35° C., 85% RH |
| Example 1 | 122 | 123 |
| Example 2 | 117 | 120 |
| Example 3 | 121 | 121 |
| Comparative Example 1 | 151 | 159 |
| Comparative Example 2 | 145 | 155 |

THE RESULTS OF EXPERIMENTS

From the results shown above, it can be confirmed that the developing compositions according to the present invention are superior to that of the comparative examples (traditional developing compositions), in relation to the picture image density, dirtiness of background, adherence of the ferrite carriers to the surface of photoconductor, and the picture image quality.

Moreover, according to a test in which 7000 sheets of paper were printed by a laser printer filled with the developing compositions produced in example 3 at a temperature of 23° C., and a humidity of 60% RH; the picture image density (ID) and the dirtiness of the surface of background (BG) were good, and a stable state was maintained.

Additionally, according to the picture image quality, the developing compositions of the present invention can exhibit the effects of small particle carriers, since the reproductivity of the thin lines by the picture image treatment assembly ("EXCEL II", produced by Japan Abionics Co., Ltd.) was always maintained at a line width of approximately 120 μm. As well, the scattering of carriers into the machine-and the adherence of carriers to the photoconductor were not observed.

EFFECT OF THE PRESENT INVENTION

In accordance with the developing compositions for use in electrophotography of the present invention, a large number of high definition and high quality picture images can be obtained in which background dirtiness is reduced, adherence of the ferrite carriers to the photoconductor surface is prevented, and a stable high image density is obtained even when environmental conditions change.

What is claimed:

1. A developing composition for use in electrophotography comprising toner which contains a binding resin and colorant as main components, and a ferrite carrier consisting essentially of 5 to 40 mol % of ZnO and 60 to 95 mol % of $Fe_2O_3$, said ferrite carrier possessing a saturated magnetization value of 70 to 100 emu/g in an applied magnetic field of 3,000 oersteds, an electrical resistance rate ranging from $10^2$ to $10^{12}$ ohm.cm and a particle size distribution ranging from 30 to 150 μm.

2. The developing composition of claim 1, wherein less than 30 weight percent of the particle size distribution of the ferrite carrier has a particle size of 63 μm or less.

* * * * *